US010555573B2

(12) United States Patent
Yip et al.

(10) Patent No.: US 10,555,573 B2
(45) Date of Patent: Feb. 11, 2020

(54) SEAMLESS BACK BUCKLE WITH CONCEALED FITTINGS

(71) Applicants: Sek Ho Yip, Kowloon (HK); Wenyong Yan, Kowloon (HK)

(72) Inventors: Sek Ho Yip, Kowloon (HK); Wenyong Yan, Kowloon (HK)

( * ) Notice: Subject to any disclaimer, the term of this patent is extended or adjusted under 35 U.S.C. 154(b) by 0 days.

(21) Appl. No.: 16/250,169

(22) Filed: Jan. 17, 2019

(65) Prior Publication Data

US 2019/0313721 A1 Oct. 17, 2019

(30) Foreign Application Priority Data

Apr. 16, 2018 (CN) ..... 2018 2 0539780 U

(51) Int. Cl.
*A41F 1/00* (2006.01)
*A44B 13/00* (2006.01)

(52) U.S. Cl.
CPC ..... *A41F 1/006* (2013.01); *A44B 13/0052* (2013.01)

(58) Field of Classification Search
CPC ..... A41F 1/006; A44B 13/0052
USPC ..... 450/72; 24/697.2
See application file for complete search history.

(56) References Cited

U.S. PATENT DOCUMENTS 7,128,635 B1 * 10/2006 Liu ..... A41C 3/0014 450/39
7,722,433 B2 * 5/2010 Utaka ..... A44B 13/00 450/63

* cited by examiner

*Primary Examiner* — Robert Sandy
(74) *Attorney, Agent, or Firm* — Maier & Maier, PLLC

(57) ABSTRACT

A seamless back buckle with concealed fittings, including a substrate and a plurality of rows of fittings disposed on the substrate; wherein the substrate includes a surface layer and a bottom layer, an interlayer is disposed between the surface layer and the bottom layer, and the plurality of rows of fittings are disposed in the interlayer; and a through hole is formed at a position corresponding to each fitting on the surface layer, and each through hole is communicated with an interior of the interlayer. A new concealed structure is adopted for the fittings of the back buckle, which provides a new idea for the underwear market, and can effectively simplify production procedures and reduce production costs.

7 Claims, 6 Drawing Sheets

SEAMLESS BACK BUCKLE WITH CONCEALED FITTINGS

TECHNICAL FIELD

The invention relates to the technical field of women's underwear, in particular to a seamless back buckle with concealed fittings and underwear having the seamless back buckle with concealed fittings.

BACKGROUND ART

In the traditional underwear industry, most underwear is designed with a back buckle. The back buckle is mainly used for allowing a user to adjust the tightness of the underwear. At present, the back buckle on the market basically has such as structure that a plurality of rows of exposed fittings are disposed on a substrate. The number of fittings in each row is the same and varied. The fittings of the existing back buckle are exposed to the outside, and there is no back buckle of underwear with a design of concealed fittings on the market.

SUMMARY

In view of the deficiencies in the prior art, the invention aims to provide a seamless back buckle with concealed fittings and underwear. A new concealed structure is adopted for the fittings of the back buckle, which provides a new idea for the underwear market, and can effectively simplify production procedures and reduce production costs.

In order to achieve the above object, the invention adopts the following technical solutions:

a seamless back buckle with concealed fittings includes a substrate and a plurality of rows of fittings disposed on the substrate; the substrate includes a surface layer and a bottom layer, an interlayer is disposed between the surface layer and the bottom layer, and the plurality of rows of fittings are disposed in the interlayer; and a through hole is formed at a position corresponding to each fitting on the surface layer, and each through hole is communicated with an interior of the interlayer.

Further, all the through holes are linear through holes.

Furthermore, the position of each through hole corresponds to the position of one side for forming a buckling relationship with a hook of underwear on each fitting.

Furthermore, the length of the through hole is equal to or slightly larger than the length of one side for forming the buckling relationship with the hook of the underwear on the fitting.

Further, an edge of the substrate is provided with a hemming structure.

Further, the substrate is made of cloth.

Further, the fittings are made of metal or rigid plastic.

The invention also provides underwear having the seamless back buckle with concealed fittings.

The invention has the following beneficial effects:

1. At present, there is no back buckle with concealed fittings on the market, and therefore the invention brings a new idea to the existing underwear market;

2. In the invention, the fittings are always concealed in the substrate and are invisible to consumers; therefore it is not necessary to consider too much about the appearance of the fittings when selecting the material of the fittings, and the range of selectable materials is wider; and 3. At present, it is usually necessary to carry out modification processes such as dyeing and electroplating in making the fittings, and the concealed fittings allow the omission of these processes, thereby effectively simplify production procedures and reducing production costs, and also being beneficial to environmental protection.

DETAILED DESCRIPTION

The invention will be further described with reference to the accompanying drawings. It should be noted that detailed embodiments and specific operation processes are given in the following examples based on the technical solutions, but the scope of protection of the invention is not limited to these examples.

Example 1

Figure 1:
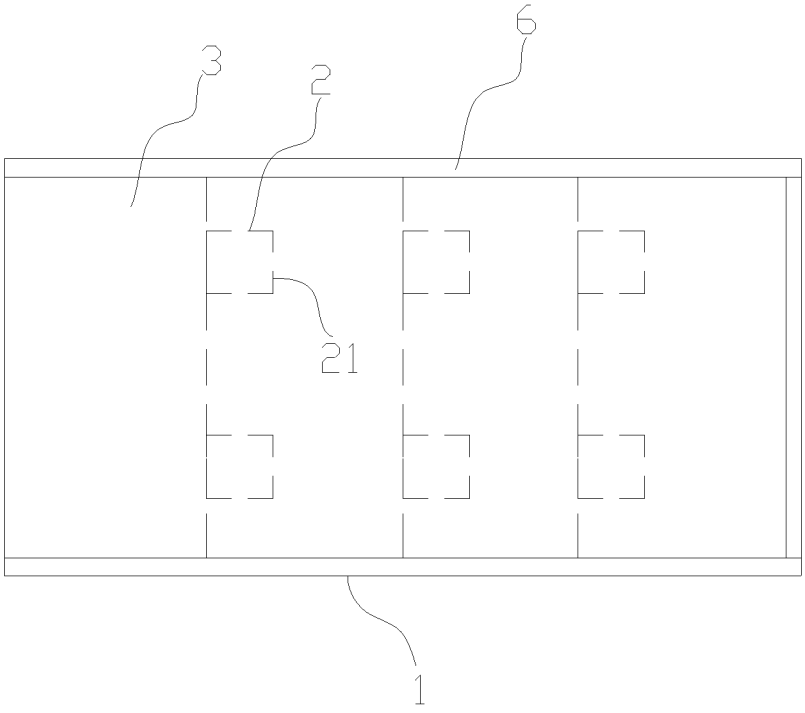
FIG. 1 is a schematic view of an overall structure of Example 1 of the invention (showing an interlayer and structures of fittings inside the interlayer)
Figure 2:
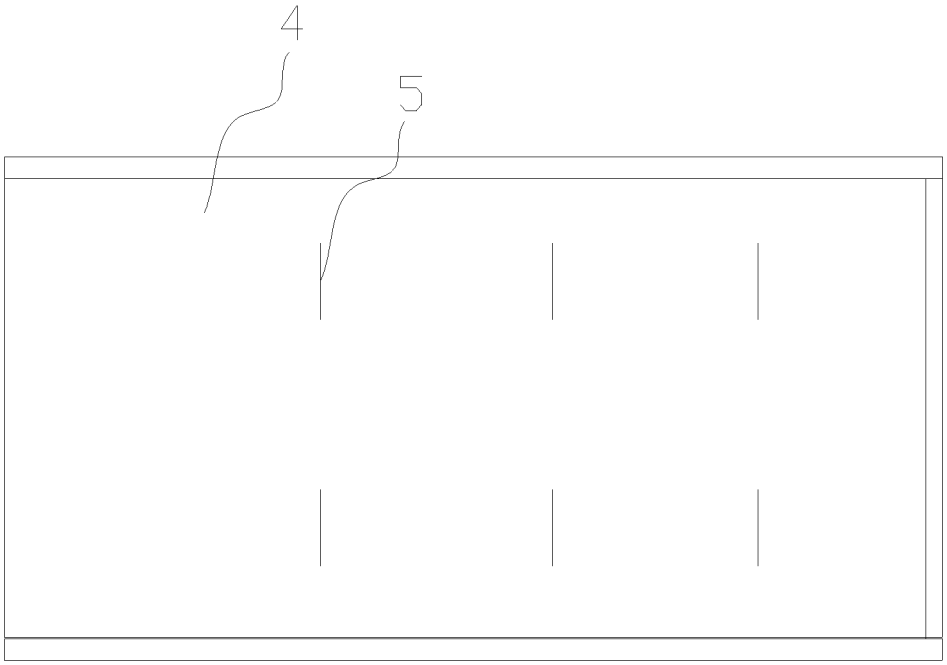
FIG. 2 is a schematic front view of Example 1 of the invention.
Figure 3:
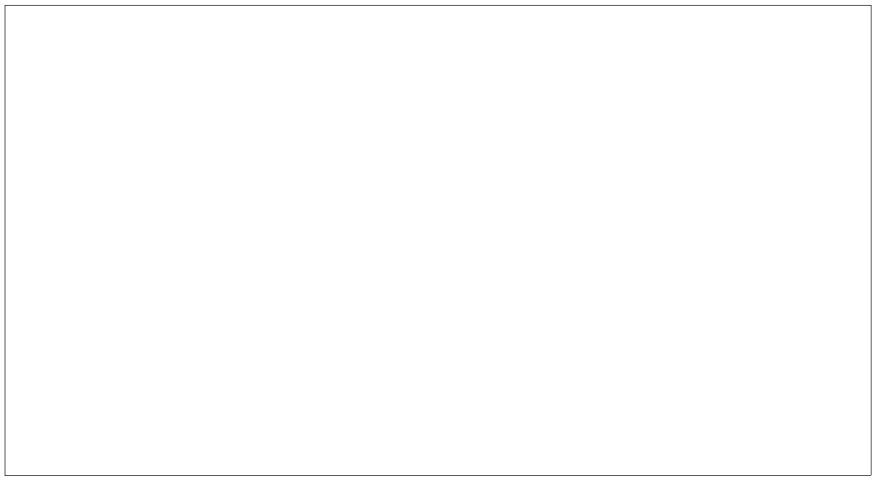
FIG. 3 is a schematic rear view of Example 1 of the invention.

As shown in FIGS. 1-3, a seamless back buckle with concealed fittings includes a substrate 1 and a plurality of rows of fittings 2 disposed on the substrate 1; the substrate 1 includes a surface layer 4 and a bottom layer 7, an interlayer 3 is disposed between the surface layer 4 and the bottom layer 7, and the plurality of rows of fittings 2 are disposed in the interlayer 3; and a through hole 5 is formed at a position corresponding to each fitting 2 on the surface layer 4, and each through hole 5 is communicated with an interior of the interlayer 3.

In use, firstly the row of fittings into which hooks of underwear are buckled is determined, and then the hooks of underwear are buckled into through holes corresponding to the positions of the row of fittings in one-to-one correspondence, so that the hooks of underwear enter the interlayer of the substrate, and are buckled into the fittings at corresponding positions.

In this example, both the surface layer 4 and the bottom layer 7 are of an integrated structure, no folding line can be seen on a front side, and no sewing thread can be seen on a back side.

In the above seamless back buckle with concealed fittings, the fittings are always concealed in the substrate and are invisible to consumers; therefore it is not necessary to consider too much about the appearance of the fittings when selecting the material of the fittings, and the range of selectable materials is wider. Moreover, at present, it is usually necessary to carry out modification processes such as dyeing and electroplating in making the fittings, and the concealed fittings allow the omission of these processes, thereby effectively simplify production procedures and reducing production costs, and also being beneficial to environmental protection.

Further, all the through holes 5 are linear through holes. The linear through holes allow for more complete concealing of the fittings.

Furthermore, the position of each through hole 5 corresponds to the position of one side 21 for forming a buckling relationship with a hook of underwear on each fitting 2. Due to the above arrangement, the hooks of underwear can be quickly buckled into the corresponding fittings after being buckled into the through holes, which helps the quick positioning of the hooks, and the hooks cannot exert excessive pulling forces on the substrate at portions of the through holes, thereby being beneficial to the protection of the substrate and preventing the substrate from being damaged during long-term use.

Furthermore, the length of the through hole 5 is equal to or slightly larger than the length of one side 21 for forming the buckling relationship with the hook of the underwear.

Further, an edge of the substrate 1 is provided with a hemming structure 6. The hemming structure can effectively prolong the service life of the substrate.

Further, the substrate 1 is made of cloth.

Further, the fittings 2 are made of metal or rigid plastic.

The above seamless back buckle with concealed fittings can be applied to underwear of various sizes.

Example 2

Figure 4:
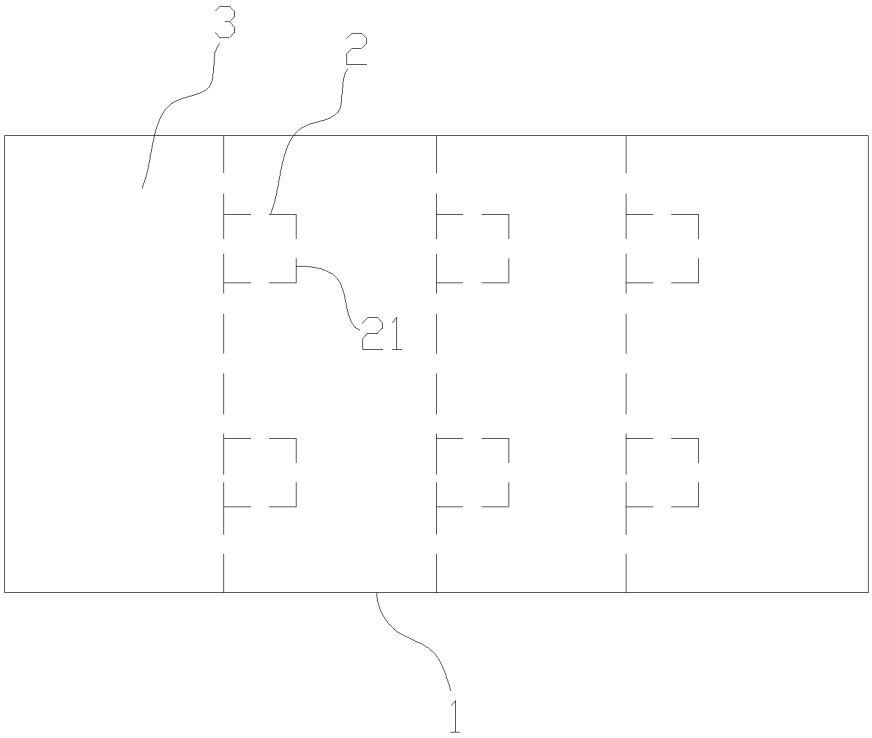
FIG. 4 is a schematic view of an overall structure of Example 2 of the invention (showing an interlayer and structures of fittings inside the interlayer)
Figure 5:
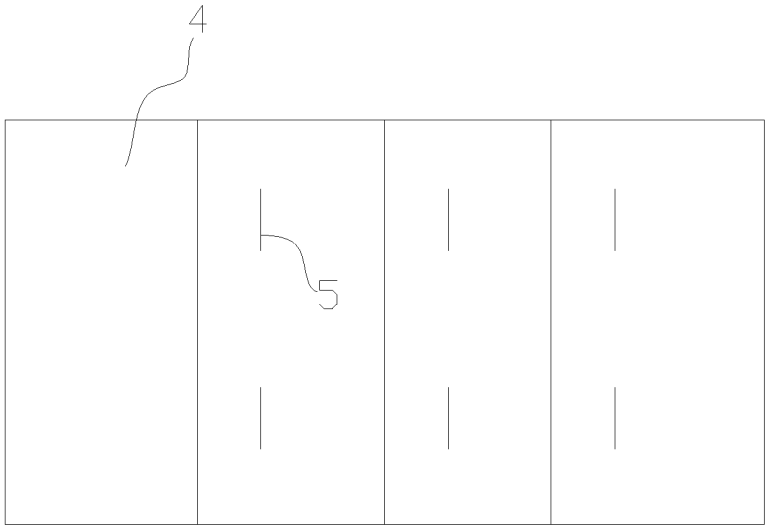
FIG. 5 is a schematic front view of Example 2 of the invention.
Figure 6:
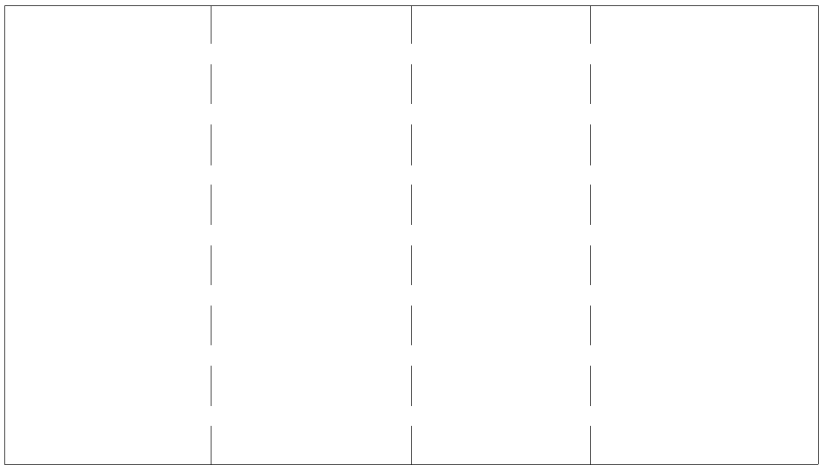
FIG. 6 is a schematic rear view of Example 2 of the invention.

As shown in FIGS. 4-6, in terms of structure, a seamless back buckle with concealed fittings in this example is substantially the same as the seamless back buckle with concealed fittings in Example 1. But in this example, a surface layer and a bottom layer are not an integrated structure, such that a folding line can be seen on the surface layer and a sewing thread can be seen on a back side. Moreover, in this example, an edge of a substrate 1 is not provided with a hemming structure 6.

Example 3

Figure 7:
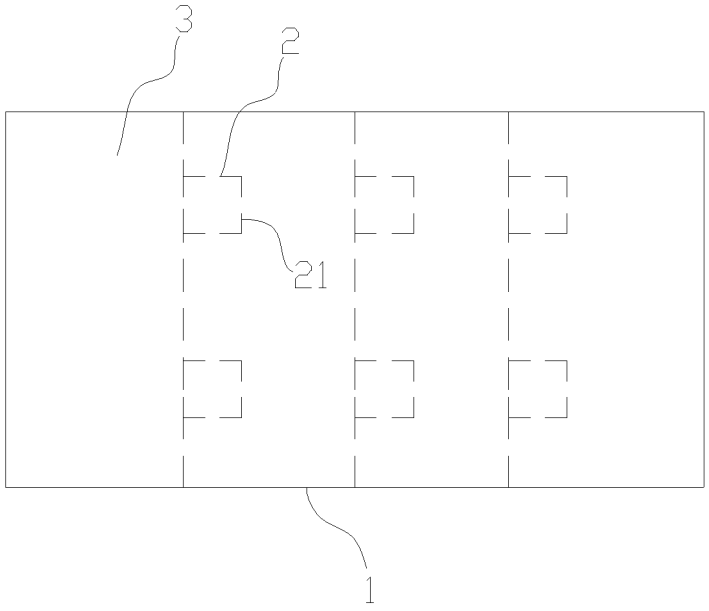
FIG. 7 is a schematic view of an overall structure of Example 3 of the invention (showing an interlayer and structures of fittings inside the interlayer)
Figure 8:
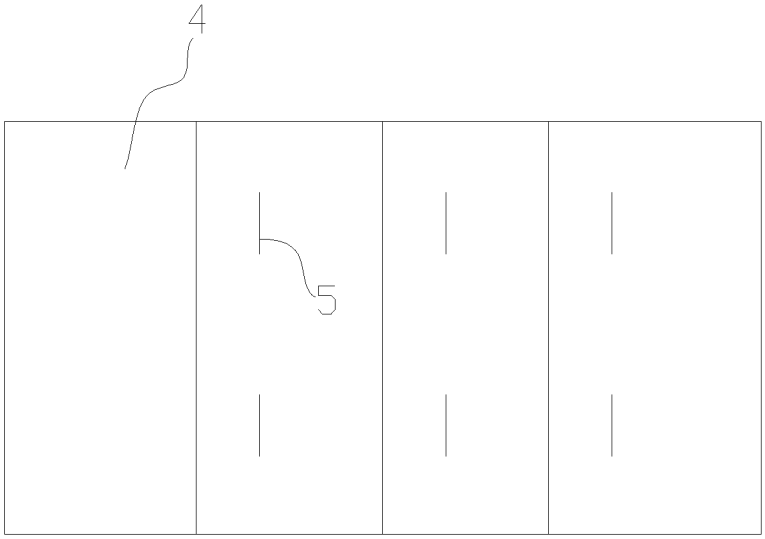
FIG. 8 is a schematic front view of Example 3 of the invention.
Figure 9:
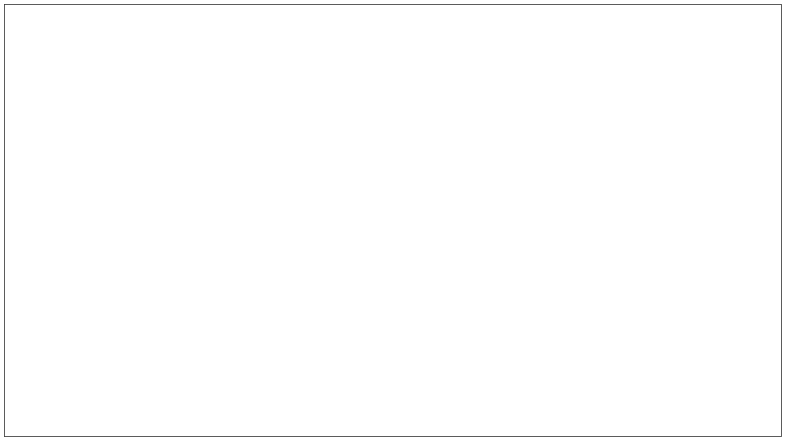
FIG. 9 is a schematic rear view of Example 3 of the invention.

As shown in FIGS. 7-9, in terms of structure, a seamless back buckle with concealed fittings in this example is substantially the same as the seamless back buckle with concealed fittings in Example 2. But in this example, a bottom layer is integrated, such that no sewing thread can be seen (as shown in FIG. 9).

Example 4

Figure 10:
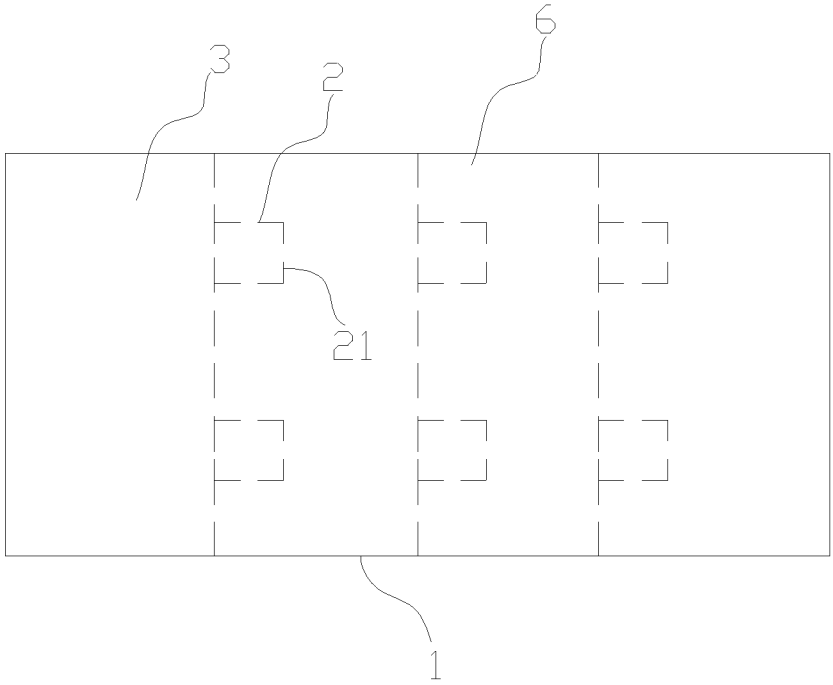
FIG. 10 is a schematic view of an overall structure of Example 4 of the invention (showing an interlayer and structures of fittings inside the interlayer)
Figure 11:
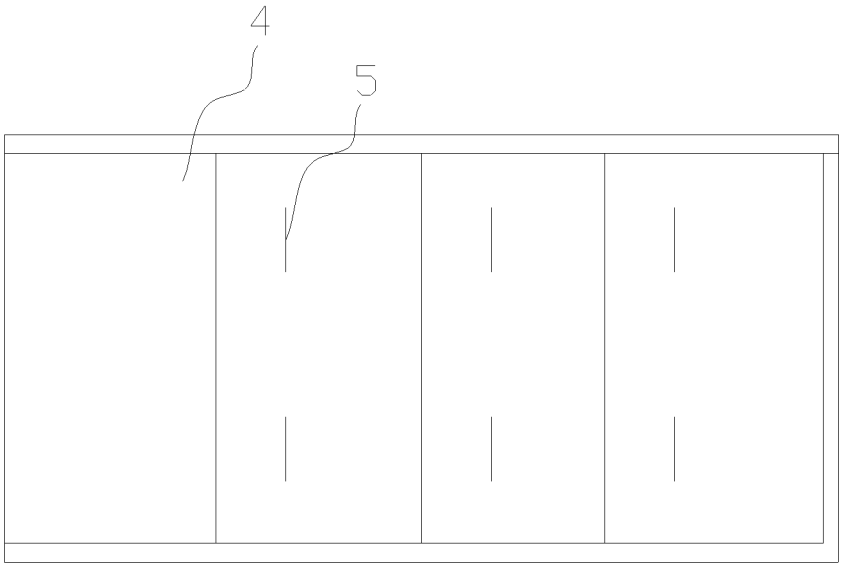
FIG. 11 is a schematic front view of Example 4 of the invention.
Figure 12:
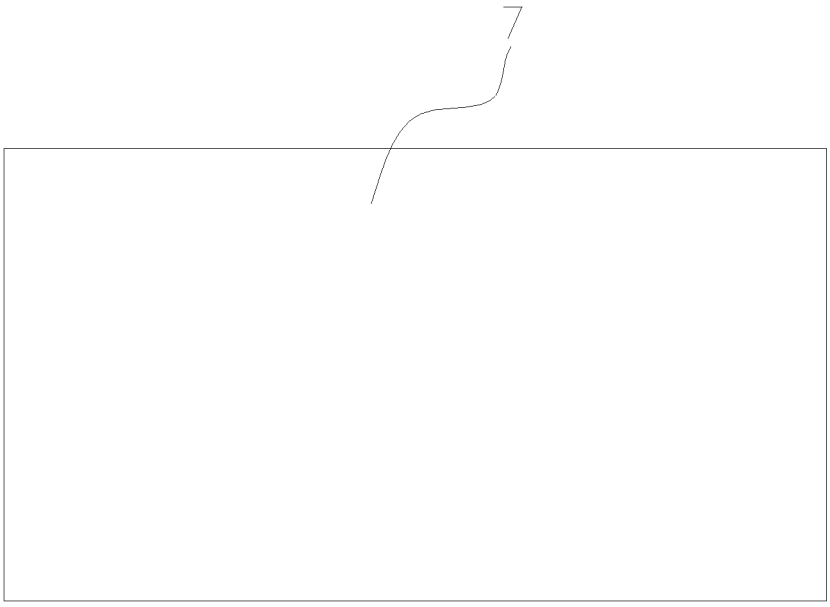
FIG. 12 is a schematic rear view of Example 4 of the invention.

As shown in FIGS. 10-12, in terms of structure, a seamless back buckle with concealed fittings in this example is substantially the same as the seamless back buckle with concealed fittings in Example 1. In this example, a hemming structure 6 is coated at edges of both a surface layer and a bottom layer, and a folding line can be seen on the surface layer.

For those skilled in the art, various corresponding changes and variations may be given based on the above technical solutions and conception, while all these changes and variations should be included in the scope of protection of the claims of the invention.

The invention claimed is:

1. A seamless back buckle, comprising:

a substrate and a plurality of rows of concealed fittings disposed on the substrate; wherein the substrate further comprises a surface layer and a bottom layer, an interlayer is disposed between the surface layer and the bottom layer, and the plurality of rows of concealed fittings are disposed in the interlayer; and a through hole is formed at a position corresponding to each fitting on the surface layer, and each through hole is communicated with an interior of the interlayer; and wherein an edge of the substrate is provided with a hemming structure.

2. The seamless back buckle according to claim 1, wherein all the through holes are linear through holes.

3. The seamless back buckle according to claim 2, wherein the position corresponding to each fitting on the surface layer also corresponds to a position of one side of a concealed fitting in one of the plurality of rows of concealed fittings for forming a buckling relationship with a hook of underwear on each fitting.

4. The seamless back buckle according to claim 2, wherein the through hole has a length that is equal to or slightly larger than a length of one side of the corresponding concealed fitting concealed for forming a buckling relationship with a hook of underwear on each fitting.

5. The seamless back buckle according to claim 1, wherein the hemming structure is coated at edges of the surface layer and the bottom layer.

6. The seamless back buckle according to claim 1, wherein the substrate is made of cloth.

7. The seamless back buckle according to claim 1, wherein the fittings are made of metal or rigid plastic.

* * * * *